US005230456A

United States Patent [19]

Germann et al.

[11] Patent Number: 5,230,456

[45] Date of Patent: * Jul. 27, 1993

[54] DRAW-ROLLER UNIT FOR A WEB-PRINTING MACHINE

[75] Inventors: Albrecht J. Germann; Johannes G. Schaede, both of Wuerzburg; Joachim A. H. Lapp, Margetshöchheim, all of Fed. Rep. of Germany

[73] Assignee: De La Rue Giori, S.A., Lausanne, Switzerland

[ * ] Notice: The portion of the term of this patent subsequent to Nov. 5, 2008 has been disclaimed.

[21] Appl. No.: 561,978

[22] Filed: Aug. 1, 1990

[30] Foreign Application Priority Data

Aug. 30, 1989 [CH] Switzerland ..... 03149/89

[51] Int. Cl.[5] ..... B41F 5/16

[52] U.S. Cl. ..... 226/95; 226/194

[58] Field of Search ..... 226/7, 93, 95, 97, 190, 226/193, 194

[56] References Cited

U.S. PATENT DOCUMENTS

| | | | |
|---|---|---|---|
| 3,587,962 | 6/1971 | Herzhoff et al. | 226/95 |
| 3,698,614 | 10/1972 | Mohr et al. | 226/193 |
| 3,796,361 | 3/1974 | Rueckert | 226/193 |
| 3,926,353 | 12/1975 | Gay | 226/95 |
| 4,029,249 | 6/1977 | Nagel et al. | 226/95 |
| 4,207,998 | 6/1980 | Schmid | 226/95 |
| 4,328,626 | 5/1982 | Leitner | 226/95 X |
| 4,344,552 | 8/1982 | Gref | 226/95 |
| 4,381,212 | 4/1983 | Roberts | 226/95 X |
| 4,925,080 | 5/1990 | Crouse et al. | 226/97 X |
| 4,998,658 | 3/1991 | Distefano et al. | 226/95 |
| 5,062,360 | 11/1991 | Germann et al. | 101/152 |

FOREIGN PATENT DOCUMENTS

| | | | |
|---|---|---|---|
| 2000436 | 7/1971 | Fed. Rep. of Germany | 226/95 |
| 2943894 | 9/1980 | Fed. Rep. of Germany | 226/95 |
| 3135696 | 12/1987 | Fed. Rep. of Germany . | |

*Primary Examiner*—Daniel P. Stodola
*Assistant Examiner*—Paul Bowen
*Attorney, Agent, or Firm*—Kane, Dalsimer, Sullivan, Kurucz, Levy, Eisele and Richard

[57] ABSTRACT

The draw-roller unit has only one suction roller (20*b*, 21*b*) as a draw roller, in which a constantly acting suction effect is effective along that circumferential portion round which the paper web is looped, whilst the remaining circumferential portion experiences no suction effect. The suction roller has a fixed hollow roller core (65) and a roller casing (61) rotatable about this and consisting of plastic-impregnated carbon fibres, with suction ports (62) distributed over its circumference. The roller core (65) is equipped, on its one side, with an axial connection piece (68*b*) for fastening to the machine stand and for connection to a vacuum source, on its other side with a bearing journal (66) and, on its circumference having passage orifices (70) with two radial partition walls (69) which are arranged at a specific angular distance from one another and which enclose a suction chamber between them. The roller casing is mounted on the bearing journal (66) a conical connecting flange (61*b*) fastened directly to the rotor shaft of the drive motor and is mounted with its other end on the connection piece (68*b*), the gaps between roller casing and partition walls (69) being approximately airtight. Instead of a suction roller, a draw roller subjected to compressed air on the outside along the circumferential portion can also be provided, or else the suction-air and compressed-air effects are combined.

8 Claims, 7 Drawing Sheets

DRAW-ROLLER UNIT FOR A WEB-PRINTING MACHINE

FIELD OF THE INVENTION

The invention relates to a draw-roller unit for the transport of a paper web in a web-fed printing machine.

PRIOR ART

Hitherto known draw-roller units used in web-fed printing machines and serving for transporting the paper web consist respectively of two rollers, namely a driven draw roller and a pressure roller pressing the paper web against this draw roller. Since the paper web is gripped on both sides between these two rollers, these draw-roller units can be used after the printing of a paper web in a printing unit, only when there is the guarantee that the fresh printing ink has already dried sufficiently when the paper web runs through the draw-roller unit after being printed.

Whereas the printing ink used in offset printing can be dried by means of relatively short drying devices, so that a draw-roller unit drawing the paper web can be provided behind the printing nip at a distance corresponding to this short drying path, where intaglio printing is concerned the drying path is so long, because of the substantially more slowly drying intaglio printing ink forming relief-life color designs, that hitherto known draw-roller units can be installed only at a very great distance behind the printing nip. Otherwise, not only would the roller of the draw-roller unit coming in contact with the freshly printed side of the paper web be soiled, but the fresh color relief would also be leveled out. Because of this long drying path, it has hitherto been impossible to operate particularly web-fed intaglio printing machines with a paper-web transport by pilgrim step, requiring draw-roller units at as short a distance as possible in front and behind the printing nip.

Furthermore, in the installation of hitherto known draw-roller units, in each case two rollers with their bearings have to be mounted, adjusted relative to one another, and this increases the outlay in terms of material and labor.

Whereas, in conventional web-fed printing machines with continuous paper-web transport, in which no relatively high accelerations and no rapid changes of speed generally occur, the known draw-roller units entail essentially the abovementioned disadvantages, in web-fed printing machines with paper-web transport controllable in the pilgrim-step mode there are, in addition to the abovementioned problem in intaglio printing, also further problems which are associated with the very rapid changes of speed in the paper-web transport. Such a web-fed printing machine working with conventional draw-roller units of the above-described type is known from DE-C-3,135,696 and serves for printing a paper web with variable formats following one another. For this purpose, in front of the printing nip of the printing unit there are a first and a second draw-roller unit and between them a first paper-web store and, after the printing nip, there are a third and a fourth draw-roller unit and between them a second paper-web store; the first and fourth draw-roller units are driven continuously for a uniform movement of the paper web, whilst the second and third draw-roller units are each controlled by a regulated electromotive drive for the forward and backward movement of the paper web. All the draw-roller units each consist of a draw roller and of a pressure roller pressing the paper web against this.

In these web-fed printing machines working in the so-called pilgrim-step mode or stop-and-go mode, the paper web is transported by the two cylinders forming the printing nip, that is to say, as regards a recto-verso printing machine working by offset printing, the two blanket cylinders, as long as these sector-shaped cylinders act on the paper web during the printing. The preceding and following draw-roller units are controlled in such a way that they generate a specific paper-web tension. In contrast, when the cylinder pits of these two cylinders run through the printing nip, the said second and third controlled draw-roller units transport the paper web in such a way that this is braked to a stop within fractions of a second, is then moved backwards a predetermined distance, is then once more braked to a stop and is accelerated again in the forward direction up to the normal operating speed.

The known draw-roller units are unfavorable for executing these braking and accelerating operations occurring rapidly, because, on the one hand, the masses of the two rollers have to be braked and accelerated rapidly and, on the other hand, the two rollers have to be pressed against one another with a very high force, in order reliably to prevent a slip of the paper web. However, it has been shown that, in the event of rapid changes of speed of the controlled draw roller, the non-driven freely rotatable pressure roller which has to be taken up by the paper web itself cannot follow pronounced brakings and accelerations and therefore results in a slip of the paper web, this of course impairing perfect printing and a correct registering.

SUMMARY OF THE INVENTION

The object on which the present invention is based is to provide a draw-roller unit which works without a pressure roller, loads only one side of the paper web, guarantees a slip-free transport of the paper web and particularly makes it possible to impart to the paper web rapid specific changes of speed with high accelerations, as are desirable in web-fed printing machines with a paper-web transport controllable in the pilgrim-step mode.

According to the invention, this object is achieved in that the draw-roller unit has a single draw roller, round which the paper web is looped along a specific circumferential portion, and in that there are means for generating an air-pressure effect along this circumferential portion, in such a way that on this circumferential portion the paper web is pressed against the surface of the draw roller, whereas the remaining circumference of this draw roller experiences no such effect.

Preferably, the draw roller is a hollow suction roller which is equipped on its circumference with suction ports and which is connected to a suitable vacuum source. However, it is also possible to use a draw roller which is subjected to compressed air from outside along the circumferential portion round which the paper web is looped, in such a way that the paper web is pressed against the circumference of the draw roller by this compressed air. Advantageously, at the same time, the draw roller is likewise equipped on its circumference with orifices which open into an inner cavity connected to the outside air. Thus, the inner face of the paper web covering the orifices is subjected to the normal atmospheric pressure, whereas the outer face of the paper web is under overpressure. Furthermore, the draw roller according to the invention can be such that the pressing force acting on the paper web is generated by a combination of the vacuum prevailing in the roller interior and the external overpressure.

Suction rollers have hitherto been known only for the transport of individual articles, such as especially securities, as is described, for example in US-A 4299325. In this, a suction roller serves for separating marked securities from a series of successive securities which are transported continuously along a feed track and which are conveyed on the feed track by a chain with striking fingers. When a security is to be separated out, the suction roller is connected to a vacuum source and thus lifts off from the feed track this security which is further transported on the circumference of the suction roller, conveyed by this to a further suction roller and finally delivered to a magazine. However, during the separation and during the transport of securities by suction rollers, there are virtually only forces which act radially relative to the roller and which merely have to be sufficient to bring a security, which of course has a very low weight, to bear on the roller circumference. Tensile forces acting in the tangential direction, such as occur to a considerable extent during the transport of an endless paper web, play no part in the security transport. Consequently, simple suction rollers have not hitherto been taken into consideration as draw rollers for paper-web transport, for which a sufficiently firm grip of the web between two rollers has been deemed necessary.

Since the draw-roller unit according to the invention has only one draw roller and the pressure roller required hitherto is omitted, the construction and assembly are simplified. Moreover, the omission of the pressure roller makes it possible to print the paper web on one side in an intaglio printing unit in the pilgrim-step mode, since a draw roller according to the invention, round which the non-printed paper-web side is looped, can be installed immediately behind the printing nip. With hitherto known tension and pressure rollers, it has not been possible to carry out intaglio printing in the pilgrim-step mode, because the drying of the freshly printed paper web is not possible in front of the draw-roller unit owing to the length of the drying path necessary for the intaglio printing ink.

Preferably, the draw roller according to the invention has a rotating roller casing made of a light plastic, especially of carbon fibers impregnated with synthetic resin, so that the moved masses are particularly low and have only a low moment of inertia, thus making it possible to achieve extremely rapid changes of speed within fractions of seconds during a paper-web transport controlled in the pilgrim-step mode.

The high adhesion of the paper web on the circumference of the draw roller, necessary for slip-free transport, is presumably assisted, on a roller casing equipped with ports, by the fact that the paper web curves a little into the ports of the draw roller under the suction effect or the compressed-air effect, thereby reliably preventing a possible displacement of the paperweb relative to the draw roller, even under high accelerations. The air-pressure differences between the outer face of the paper web and its inner face covering the ports in the roller casing, necessary for a reliable adhesion of the paper web, are around 0.1 to 0.8 bar, depending on the type of paper.

Expedient embodiments of the invention emerge from the dependent patent claims.

BRIEF DESCRIPTION OF THE DRAWINGS

The invention is described in detail by means of the drawings with reference to three exemplary embodiments. In the drawings.

DESCRIPTION OF THE PREFERRED EMBODIMENTS

Figure 1:
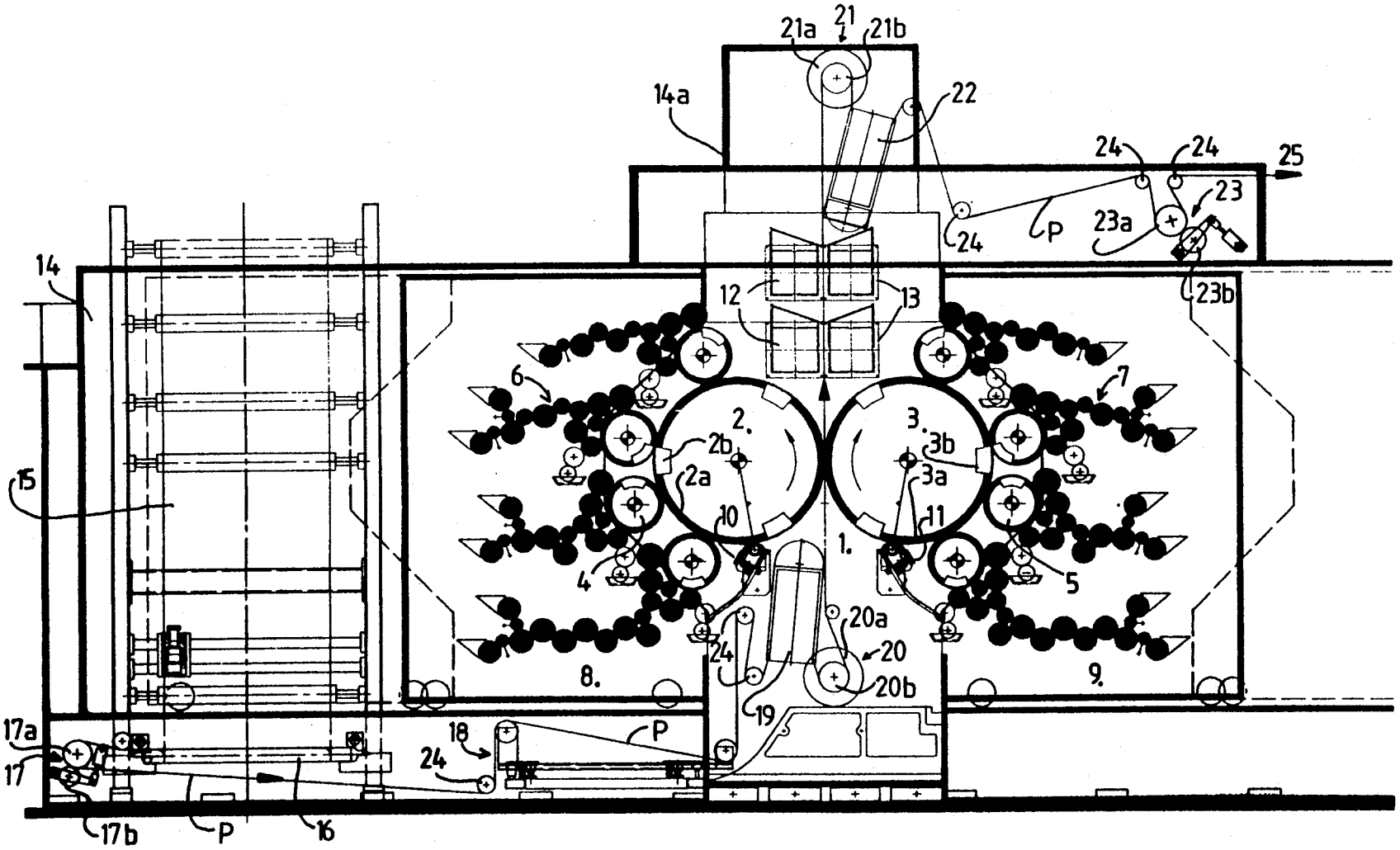
FIG. 1 shows a diagrammatically represented web-fed printing unit which is equipped with two draw-roller units according to the invention for paper-web transport in the pilgrim-step mode.

First, by reference to FIG. 1, the general construction of a web-fed printing machine and the transport device for the paper web, working in the pilgrim-step mode, and then examples of draw rollers are described.

The web-fed printing machine, illustrated in FIG. 1, through which the web P to be printed runs in the direction of the arrows, is, in the example under consideration, a multicolor offset printing unit working by recto-verso printing. This printing unit has two interacting blanket cylinders 2 and 3 mounted next to one another in a stand 1 and rotating in the direction of the curved arrows, each with three sectors, on each of which a blanket *2a*, *3a* is clamped. The sectors are separated by cylinder pits *2b*, *3b*, in which the means for clamping the blankets are accommodated. This offset printing unit is therefore of a design similar to that of a sheet-fed printing machine.

Each blanket cylinder 2 and 3 interacts with four plate cylinders 4, 5 each which are mounted in the stand 1 and which carry offset printing plates and are inked in different colors by corresponding inking units 6, 7. In the example under consideration, the uppermost inking unit has a single ink fountain on each side, whilst the remaining three inking units are equipped with a double ink fountain on each side. As shown by the dampening units indicated in FIG. 1 and assigned to each inking unit, the example under consideration relates to a wet offset printing machine which can also alternatively be operated as an indirect typographic printing unit or in a combination of the two processes. All the inking units 6 on one side are arranged in a removable inking-unit stand 8 and all the inking units 7 on the other side are arranged in a removable inking-unit stand 9. Moreover, installed on the circumference of the blanket cylinders 2 and 3 are automatic blanket-washing devices 10 and 11 which are shifted away from the blanket cylinders during the printing operation of the machine. Installed above the blanket cylinders 2 and 3 is a paper-drying device 12 which works by UV radiation and through which the freshly printed web runs.

The transport device accommodated, together with the printing unit, in a common main stand 14 is described below.

The web P is unwound from a paper roll (not shown) and passes via a web feed device 15 and a turning rod 16 into a first draw-roller arrangement 17 consisting of a draw roller 17*a*, round which the web is looped, and of a pressure roller 17*b* which presses the web against the draw roller. This draw-roller arrangement 17 and the draw-roller arrangement 23 mentioned later are driven uniformly. Via a device 18 for the lateral alignment of the web P, the latter then passes, guided by deflecting rollers 24, into a first paper-web store 19 which, in the example under consideration, works with a vacuum chamber. A paper-web store of this type is known and is controlled in such a way that, between the draw-roller arrangement 17 and the entrance of the paper-web store 19, the paper web P is kept taut with a predetermined force and the tension of this portion of the web is kept constant at a presettable value.

At the exit of the paper-web store 19, the web runs through a draw-roller unit 20 which is individually controlled intermittently for the forward and backward movement of the web. This draw-roller unit 20 has a single suction roller as a draw roller 20*b*, the design of which is described in more detail later and which is controlled by an individual regulated drive 20*a* in the form of an electronically controlled motor. The web coming out of the paper-web store 19 loops round this draw roller 20*b* from below over approximately 180° and then, guided by a deflecting roller, runs through the printing nip formed by the two blanket cylinders 2 and 3 and thereafter through the drying device 12,13 and then loops from above round a draw roller 21*b* belonging to a second draw-roller unit 21, once again over approximately 180°. This draw-roller unit 21 installed in a stand part 14*a* above the main stand 14 is designed in the same way as the draw-roller unit 20, is controllable intermittently for the forward and backward movement of the web and is likewise moved by an individually regulated drive 21*a* in the form of an electronically controlled motor. After the draw-roller unit 21, the web passes through a second paper-web store 22 which is constructed and is controllable in exactly the same way as the paper-web store 19 and is subsequently guided via a plurality of deflecting rollers 24, and a further draw-roller arrangement 23 which is of exactly the same design as the draw-roller arrangement 17 and which has a uniformly controlled draw-roller 23*a* and a pressure roller 23*b* pressing the web against this. At the exit 25, the web leaves the printing unit and is fed to further processing stations, for example a further printing unit and then the cutting stations.

The transport device described is therefore designed in such a way that the paper web is moved continuously from its paper roll as far as the first paper-web store 19 and behind the second paper-web store 22, whilst the web portion passing through the printing nip of the printing unit is moved to and fro in a controlled way between the paper-web stores in the so-called pilgrim-step mode. It will briefly be explained:

As long as the blankets 2*a* and 3*a* of the blanket cylinders 2 and 3 act on the web P and clamp this during the printing, the web is transported by the two rotating blanket cylinders 2 and 3. But whenever two cylinder pits 2*b* and 3*b* are located opposite one another and release the web for a correspondingly short period of time, then the draw-roller units 20 and 21 transport the web. During this short phase, the paper web between the two blanket cylinders 2 and 3 is braked within fractions of a second from the normal operating speed to a stop, is then accelerated in the backward direction, is thereafter braked to a stop once again, and finally is accelerated in the forward direction up to the normal operating speed, whereupon the further transport takes place once more by means of the two blanket cylinders 2 and 3 when the blankets of the two blanket cylinders following the cylinder pits mentioned again clamp the web on both sides for the subsequent printing. This pilgrim-step mode is controlled in such a way that, in order to save paper, the printing images transferred successively onto the paper web follow one another at the predetermined close interval, and in a known way makes it possible to change the printing format, for example between the repeat lengths of 605 mm and 685 mm, measured in the transport direction, without the cylinders having to be changed. It is sufficient suitably to adjust the lengths by which the web is moved backwards and forwards relative to the circumference of the moved blanket cylinders 2 and 3 during the pilgrim-step mode, and to program the regulation of the drives 20*a* and 21*a* accordingly.

The draw-roller units 20, 21 serve at the same time for register correction, in that they are regulated as a function of read-off register marks or printing marks, and for the printing-length correction, in that, during the pilgrim-step mode, an appropriate paper-web stretch is set and maintained between the draw-rollers 20*b* and 21*b* by regulating the web tension which determines the printing length.

Figure 2:
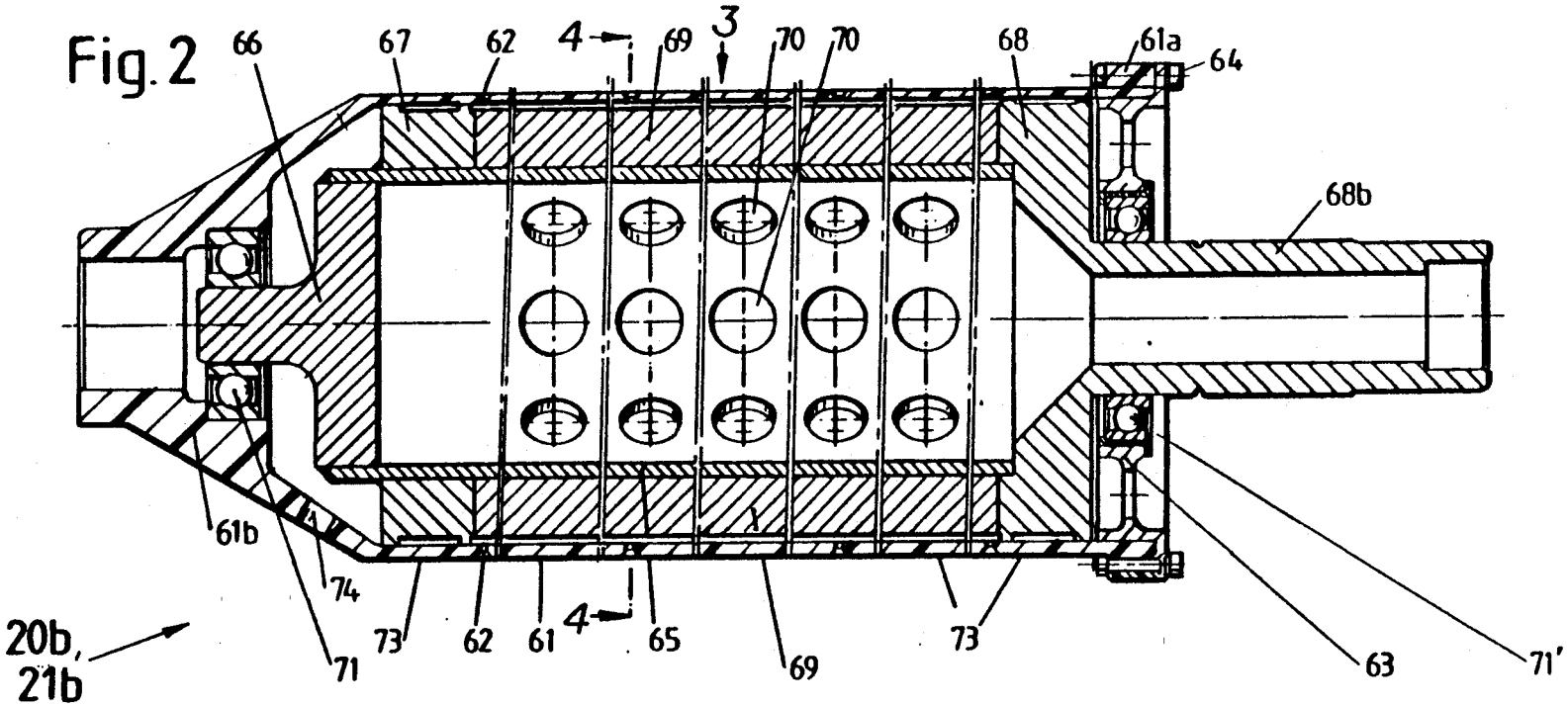
FIG. 2 shows an axial section through a first embodiment of a draw roller designed as a suction roller, along the line II—II according to FIG. 4.
Figure 3:
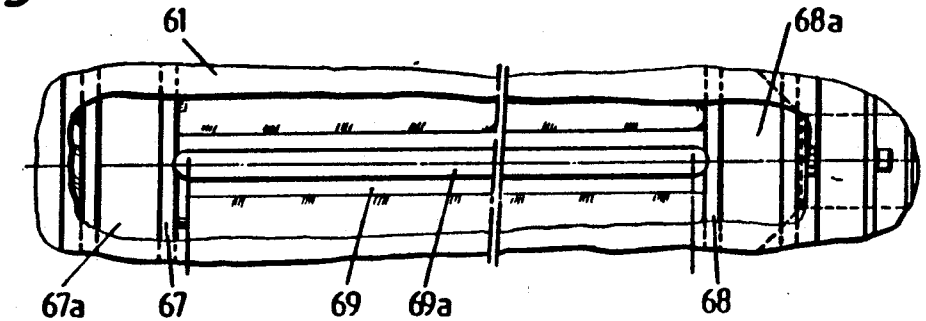
FIG. 3 shows a partially sectional part view in the direction of the arrow III according to FIG. 2.
Figure 4:
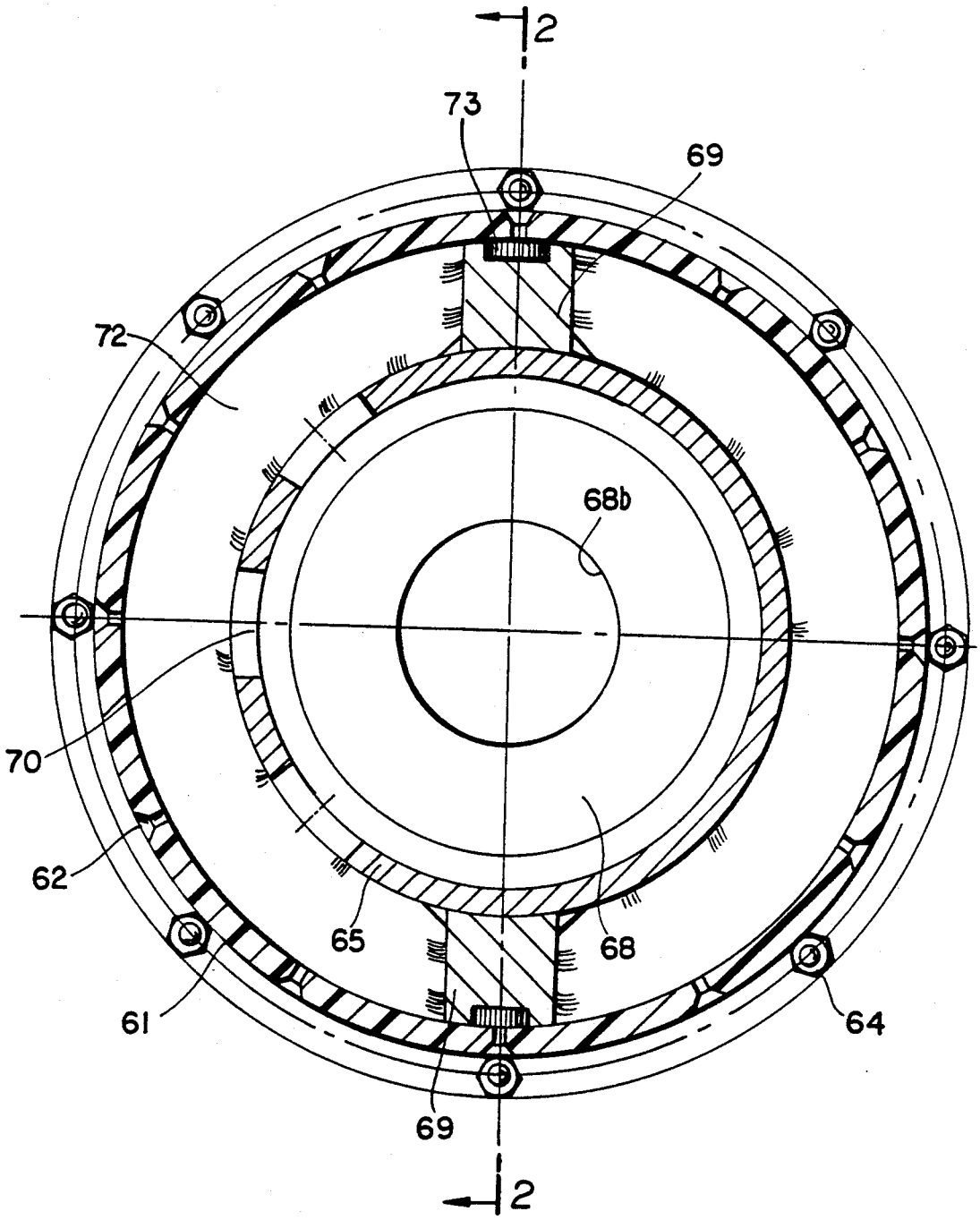
FIG. 4 shows a radial section of the suction roller along the line IV—IV according to FIG. 2, on an enlarged scale.
Figure 5:
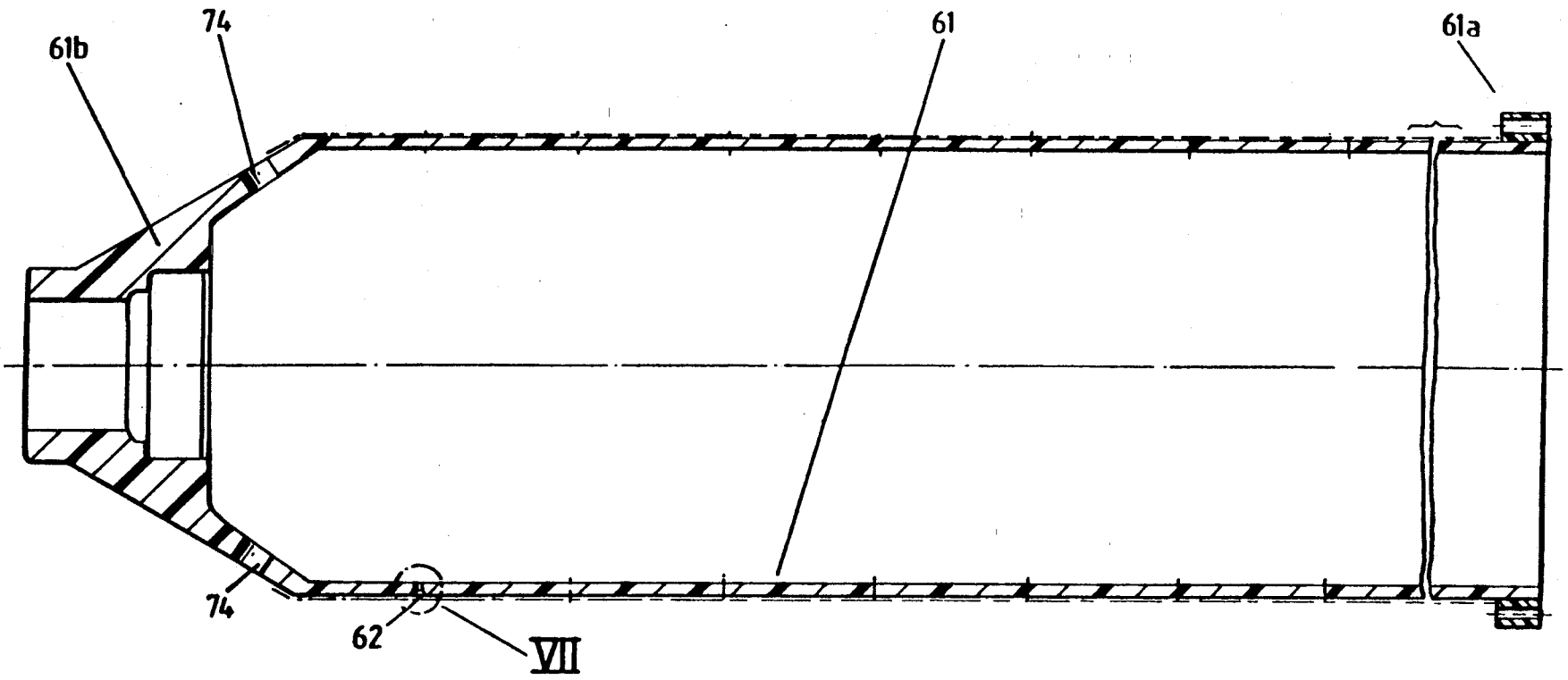
FIG. 5 shows a section through the suction-roller casing.

FIGS. 2 to 7 show a preferred embodiment of the suction roller 20*b*, 21*b* of a draw-roller unit 20, 21. According to FIG. 2, the rotating part of this suction roller consists of a roller casing 61 which is produced from a lightweight carbon-fiber-reinforced plastic (CFK), particularly from plastic-impregnated carbon fibers, and which therefore has a relatively low rotational inertia. Since, in the pilgrim-step mode, the suction roller repeatedly has to be sharply braked and accelerated rhythmically in fractions of seconds, as low a moment of inertia of the rotating part as possible is desirable. FIG. 5 shows the roller casing 61 as an individual part, and in a typical instance it has a total axial length of approximately 100 cm and a diameter of approximately 15 cm. As the interruptions indicate, the representations according to FIGS. 2 and 5 show the suction roller axially reduced.

An outer annular flange 61*a* is formed on the cylinder casing 61 at one end, and the other end is tapered conically to form a connecting flange 61*b*. On its circumference, the roller casing 61 is equipped with a plurality of suction ports 62, the distribution of which is explained further later. A flanged part 63, preferably made of light metal, is fastened to the annular flange 61*a* by means of screws 64.

The roller casing 61 is rotatable about a stationary hollow roller core 65 made preferably of metal. Fastened to the roller core 65 at the end facing the connecting flange 61*b* of the roller casing 63 is a metal bearing journal 66, the base of which sealingly closes the interior of the roller core 65. Fastened to the circumference of the roller core 65 at a specific angular distance from one another, in the example under consideration at the angular distance of 180°, are two radial partition walls 69 which preferably consist of metal and which enclose a suction chamber 72 between them, as shown especially in FIG. 4. Fastened to the circumference of the roller core 65 on the two axial sides of the partition walls 69 are annular walls 67 and 68 which likewise preferably consist of metal and which close the suction chamber 72 on its axial sides. The annular wall 68 at that end of the roller core 65 facing the flanged part 63 is extended axially by a projecting connection piece **68*b* which serves for fastening the stationary part of the suction roller to the machine stand and for connection to a vacuum source. Within the suction chamber 72, the circumferential wall of the roller core 65 is equipped with relatively large passage orifices 70. All the parts 66, 67, 68, 69 fastened to the roller core 65** are welded on in the example under consideration.

As shown in FIG. 2, the roller casing 61 is mounted rotatably at its one end with its flanged part 63 on the connection piece **68*b* by means of a bearing 71', designed as a ball bearing in the example under consideration, and at its other end with its connecting flange 61*b* on the bearing journal 66 of the roller core 65 by means of a bearing 71 likewise designed as a ball bearing. At the same time, the arrangement is such that the gaps between the inner circumference of the roller casing 61 and the radially outer ends of the partition walls 69 and the outer circumference of the annular walls 67 and 68 are sealed off at least approximately against a passage of air. In the example under consideration, this is carried out by means of a suitable sealing material 73 which is inserted into axis-parallel depressions 69*a* of the radially outer ends of the partition walls 69 and into annular depressions 67*a* and 68*a* (FIG. 3) on the circumference of the annular walls 67 and 68. This sealing material 73 can especially be, for example, a self-adhesive brush. However, the arrangement can also be such that only a very small gap, without the insertion of any particular sealing material, is provided between the inner circumference of the roller casing 61 and the partition walls 69 and the annular walls 67 and 68. Such narrow gaps offer such high resistance to a passage of air that these gaps have sufficient sealing to maintain the necessary vacuum within the suction chamber 72**.

In the assembled state, the connection piece **68*b* is connected constantly to a vacuum source, so that there is maintained inside the roller core 65 by means of the orifices 70, in the suction chamber 72 and consequently at the suction ports 62 opening respectively into this suction chamber 72 a sufficiently high vacuum, by means of which the paper web looping through 180° round the suction roller in the region of the suction chamber 72 is pressed against the outer circumference of the roller casing 61, that is to say is held by strong suction. The pressure in the roller interior should be between 0.9 and 0.2 bar, depending on the type of paper. A suitable surface treatment of the roller casing 61**, the surface of which is preferably plasma-coated for example with nickel or another metal, means that this surface becomes impact-resistant and abrasion-resistant and acquires some roughness; this ensures that, even at the high accelerations of the suction roller occurring in the pilgrim-step mode, there is no slip between the latter and the paper web which therefore participates in all the movements of the suction roller.

Figure 6:
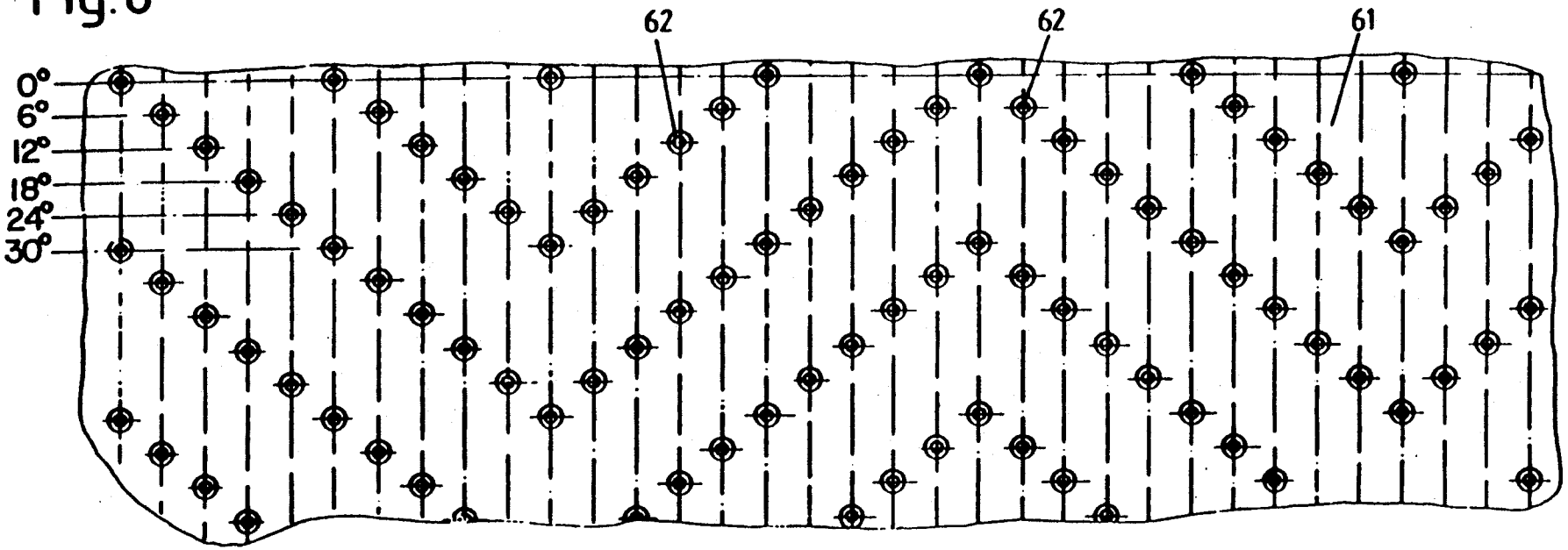
FIG. 6 shows part of the surface of the suction-roller casing, laid out in one plane, with the distribution of the suction ports.
Figure 7:
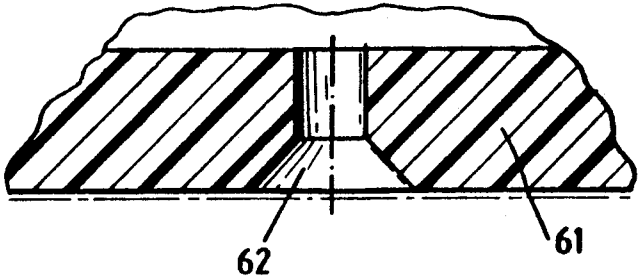
FIG. 7 shows an enlarged section through the suction-roller casing at the location VII according to FIG. 5, to illustrate the form of a suction port.

In order to obtain an easy and perfect release of the paper web from the suction roller at the end of looping, that is to say, therefore, at the end of the suction chamber 72, the suction ports 62 are distributed in a specific way shown in FIG. 6. In the representation according to FIG. 6 which shows part of the roller casing 61 laid out in one plane, the suction ports 62 are arranged in mutually parallel zigzag lines, that is to say respectively along helical portions extending in zigzag form on the roller casing 61. Thus, adjacent suction ports 62 are respectively arranged mutually offset angularly and in parallel relative to the axial direction, the angular offset amounting respectively to 6° in the example under consideration. As seen in the circumferential direction, successive suction ports are distant from one another by an angle of 30°, and the distance between adjacent suction ports along a generatrix, that is to say parallel to the axis, amounts to approximately 5 cm in the example under consideration. This on the one hand ensures a successive cutoff of the vacuum at the end of looping, so that the web is released from the suction roller without difficulty, and on the other hand guarantees a good adhesion of the web on the suction roller in the entire looping region. The shape of the suction ports 62 is shown in the enlarged representation according to FIG. 7, according to which the inner region of this suction port consists of a cylindrical bore and the outer region consists of a conical widening.

A perfect balancing of the roller casing 61 is expediently achieved by making appropriately arranged and dimensioned bores 74 in the conical wall of the connection piece **61*b* (FIGS. 2 and 5) and, if appropriate, in the annular flange 61*a* between the orifices serving for the passage of the screws 64**. If such bores are not sufficient, small studs can also be glued in on the opposite side to obtain a perfect balancing.

The roller casing 61 is pressed directly with its formed-on connecting flange **61*b*** onto the shaft of the drive motor.

Figure 9:
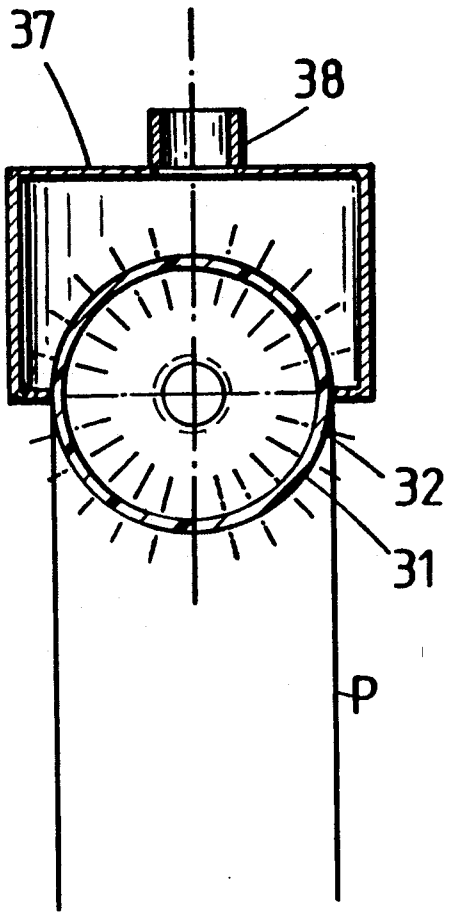
FIG. 9 shows an axial section of this.
Figure 8:
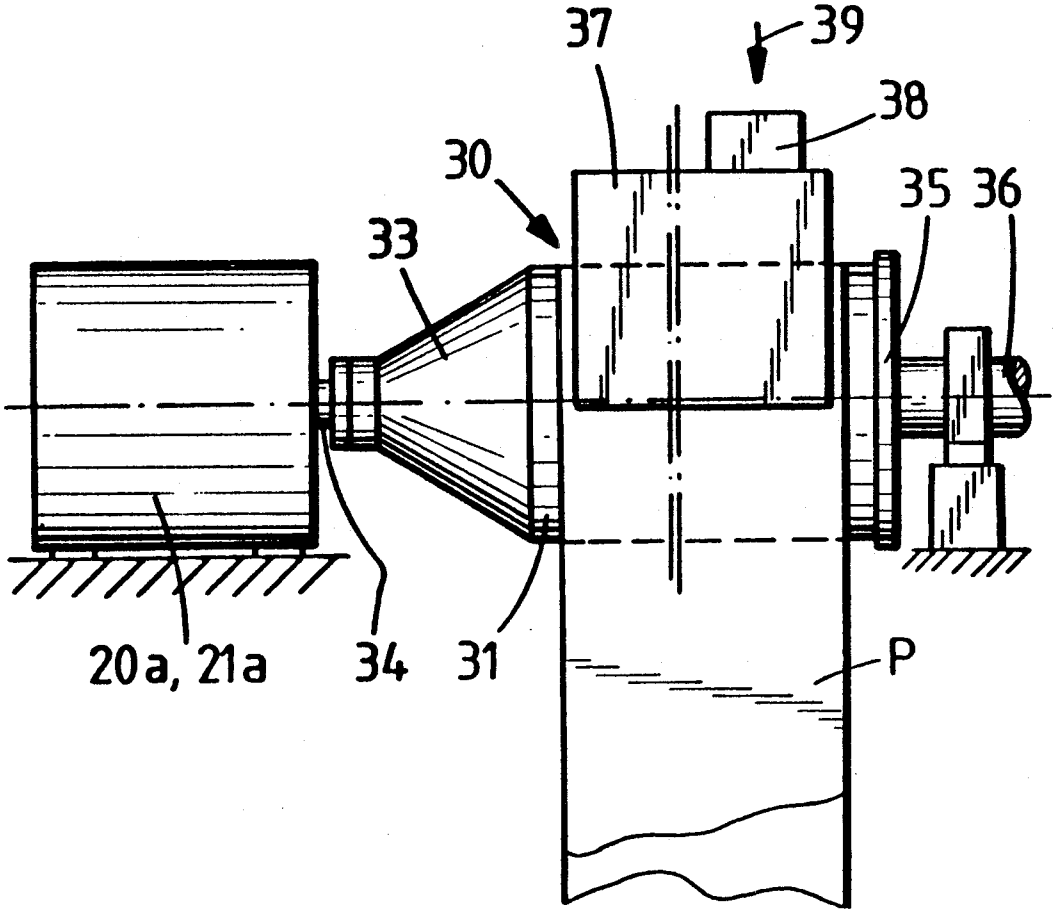
FIG. 8 shows diagrammatically a second embodiment of a draw roller.

FIGS. 8 and 9 show diagrammatically a draw roller 30 which is subjected to compressed air along the circumferential portion round which the paper web P is looped. The draw roller 30 has a rotating roller casing 31, on the circumference of which ports 32 are made in a distributed manner and which is of a design and construction similar to those of the roller casing 61 of the first exemplary embodiment. On one side, the roller casing 31 forms a conical flange 33, by means of which it is fastened fixedly in terms of rotation on the shaft 34 of the respective drive motor belonging to one of the regulated drives **20*a* or 21*a* (FIG. 1). Fastened to the other end of the roller casing 31, which again preferably consists of a light plastic, is a flanged part 35 which is arranged rotatably on a hollow connection piece 36 serving for fastening the arrangement to the machine stand and connecting the interior of the roller casing 31** to the outside air. In this case, the roller core of the draw roller described in the first exemplary embodiment can be omitted.

The draw roller 30 penetrates with a segment defined by the circumferential portion round which the paper web P is looped, in the example under consideration with its upper half, into the open side of an otherwise closed box 37 which is connected via an inlet connection piece 38 to a compressed-air source 39 indicated by an arrow. The gaps between the edges limiting the box orifice and the circumference of the roller casing 31 are only just of such a size that the paper web P can run unimpeded past this box 37, but the overpressure prevailing inside the box escapes through these gaps to only an insignificant extent. By means of the arrangement described, there is generated on the outer face of the paper web P in the region of the box 37 an overpressure which should be between 1.1 and 1.8 bar, depending on the type and quality of the paper, whilst normal atmospheric pressure prevails inside the draw roller 30. This air-pressure difference is sufficient to hold the paper web on the draw-roller in a slip-resisting manner, even under high accelerations of the latter.

Figure 11:
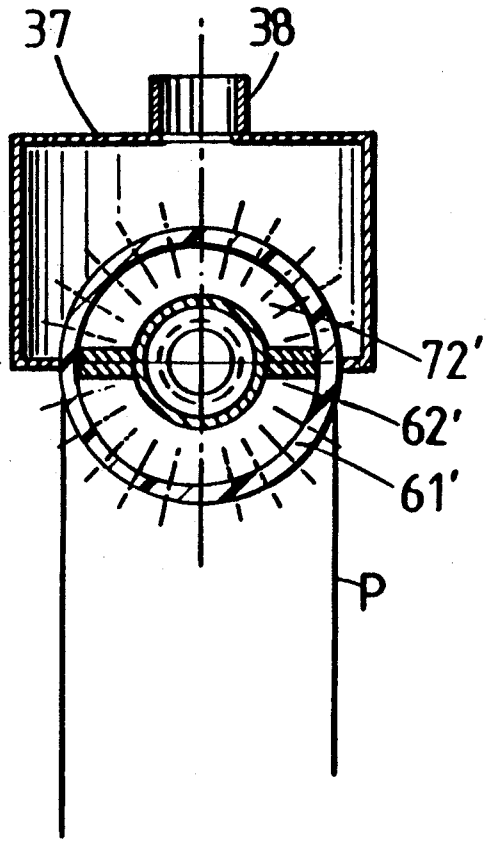
FIG. 11 shows an axial section of this.
Figure 10:
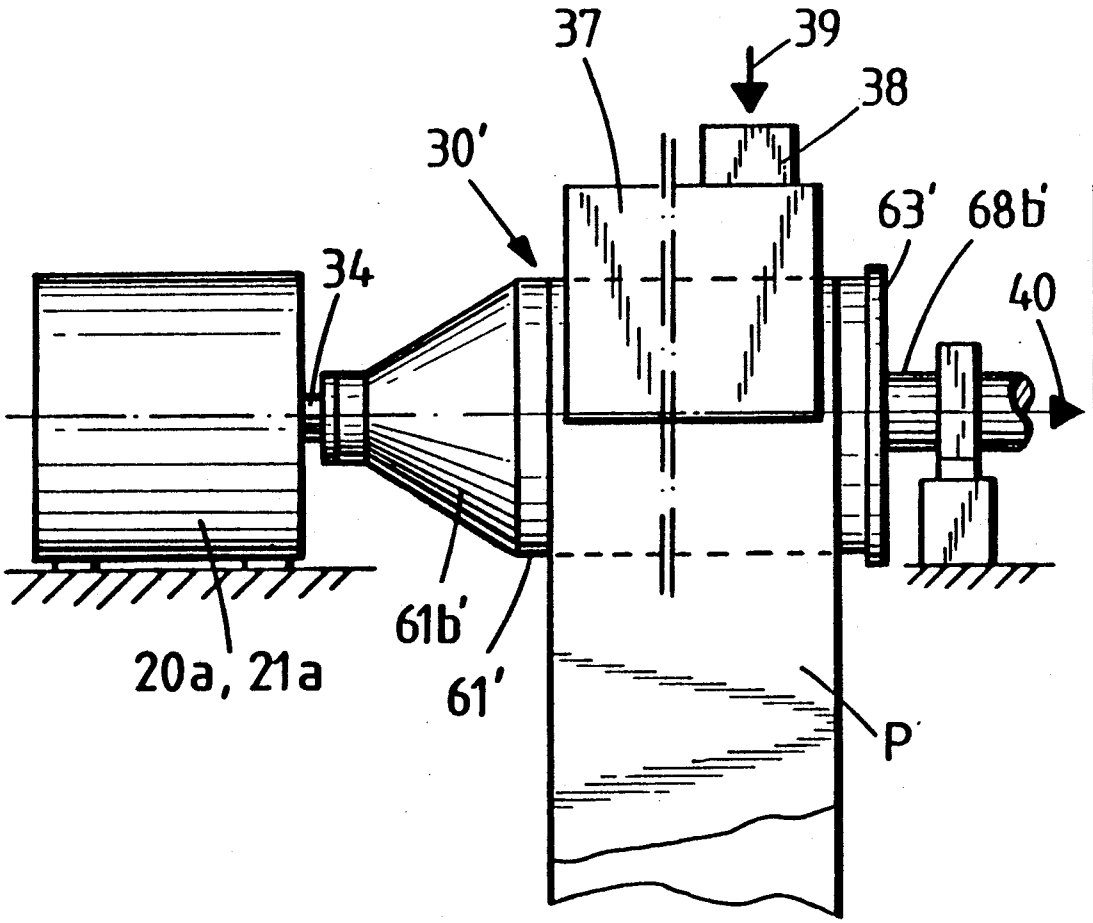
FIG. 10 shows diagrammatically a third embodiment of a draw roller.

FIGS. 10 and 11 show diagrammatically a third exemplary embodiment of a draw roller according to the invention, in which a suction effect and an external overpressure are combined to press the paper web against the draw roller. In the example under consideration, this draw roller 30' is designed as a suction roller and exactly as in the first exemplary embodiment according to FIGS. 2 to 7. Thus, the roller casing 61' equipped with ports 62' is arranged, with its conically tapering connecting flange **61*b'* provided at one end, fixedly in terms of rotation on the shaft 34 of the respective drive motor of the drive 20*a* or 21*a* and, at the other end, is mounted rotatably by means of its flanged part 63' on the hollow axial connection piece 68*b'* which itself serves for fastening and at the same time for connection to a suction-air source 40 indicated by an arrow. As in the first exemplary embodiment according to FIG. 4, formed inside the draw roller 30' is a suction chamber 72' which is connected to the hollow connection piece 68*b'*. Moreover, as in the second exemplary embodiment according to FIGS. 8 and 9, there is an outer box 37, via which the circumferential portion of the roller casing 61'** subjected to the internal suction effect is at the same time subjected to compressed air from outside. The combined suction-air and compressed-air effect achieved thereby guarantees an especially good adhesion of the paper web on the draw roller.

The invention is not restricted to the exemplary embodiments described, but permits many alternative versions as regards the design of the draw roller. Thus, for example in the second exemplary embodiment according to FIGS. 8 and 9, if appropriate the holes in the roller casing can be omitted. Also, of course, the draw roller can be employed in other printing units with a continuous paper-web transport or with a paper-web transport in the pilgrim-step mode, especially in intaglio printing units. The circumferential portion of the draw roller round which the paper web is looped can generally be between 90° and approximately 180°.

We claim:

1. A draw-roller unit for the transport of a paper web (P) in a web-fed printing machine comprising:

a draw-roller unit (20,21) having only one single suction roller (**20*b*, 21*b*; 30'**) formed by a draw roller, round which the paper web (P) is looped along a specific circumferential portion;

means for generating an air-suction effect along said specific circumferential portion, in such a way that on said specific circumferential portion on the paper web (P) is pressed against the surface of the suction roller, whereas the remaining circumferences of this suction roller experiences no such effect;

said suction roller consisting of a fixed hollow roller core (65) and a roller casing (61; 61') rotatable about said core and made of light material, consisting of plastic impregnated with carbon fibers, and provided with suction portions (62) distributed over its circumference, said suction ports being arranged in successive zig-zag patterns, each pattern consisting of line segments alternating at one of a first and a second angle with respect to the direction of movement of said web, each line segment being defined by at least three suction ports with the spacing between the suction ports of a pattern being smaller than the spacing between the patterns;

a drive motor having a rotor shaft, wherein the roller core (65) is equipped on its one side with an axial hollow connection piece (**68*b*) for fastening to a machine stand and for connection to a vacuum source, on its other side with a bearing journal (66) and on its circumference with two radial partition walls (69) arranged at a specific angular distance from one another and enclosing a suction chamber (72) between them, wherein the circumferential wall of the roller core (65) within the suction chamber has passage orifices (70), and wherein an end of the roller casing (61) facing away from the connection piece (68*b*) tapers to form a connecting flange (61*b*) which is intended for fastening to said rotor shaft of said drive motor and which is mounted rotatably on the bearing journal (66) by means of a bearing (71), whilst another end of the roller casing (61) is mounted by means of another bearing (71') on said hollow piece (68*b*); and wherein gaps are provided between an inner circumference of the roller casing (61) and radially outer ends of the partition walls (69**) which are approximately airtight.

2. The draw-roller unit as claimed in claim 1, wherein fastened on the two ends of the roller core (65) are annular walls (67, 68) which close off said suction chamber (72) at two axial ends, and wherein gaps are provided between said inner circumference of the roller casing (61) and an outer circumference of the annular walls which are approximately airtight, the annular wall (68) located on the same side as said connection piece preferably being in one piece with said connection piece (**68*b***).

3. The draw-roller unit as claimed in claim 2, wherein sealing material (73) is arranged in said gaps.

4. The draw-roller unit as claimed in claim 2, wherein the said gaps are so small that, without sealing material, they generate an air resistance sufficient for maintaining the desired vacuum in the suction chamber (72).

5. The draw-roller unit as claimed in claim 1, wherein fastened to said other end of the roller casing (61) is a flanged part (63) which is mounted on the said connection piece (**68*b*) by means of the other of said bearings (71'**).

6. The draw-roller unit as claimed in claim 1, wherein the surface of the roller casing (31, 61, 61') is treated to eliminate slippage between the roller casing and the web.

7. The draw-roller unit as claimed in claim 1, wherein the suction roller (**20*b*, 20*b*; 30; 30') is an integral part of a web-fed intaglio printing machine with a paper-web transport controllable in the pilgrim-step mode, for the forward and backward movement of the paper web (P) there being installed, in front of the printing nip, a paper-web store (19) and a following suction roller and, immediately behind the printing nip, a suction roller with a following paper-web store (22), and the two suction rollers each being controllable by a regulated drive (20***a*, 21*a*).

8. The draw-roller unit as claimed in claim 1 wherein said zig-zag patterns overlap, with an imaginary line transversal to the direction of movement of said web crossing through more than one zig-zag pattern.

* * * * *